United States Patent [19]

Nentwich et al.

[11] Patent Number: 5,040,481

[45] Date of Patent: Aug. 20, 1991

[54] APPARATUS FOR THE REMOVAL OF THICKENINGS FORMED IN COATINGS TRANSVERSELY TO THE DIRECTION OF MOVEMENT OF A COATED WEB

[75] Inventors: Reinhold Nentwich, Diessen; Reinhard Krätschmer, Munich; Siegfried Rieger, Groebenzell; Johann Baarfüsser, Gauting; Lothar Langer, Munich; Joachim Mittmeyer, Neuried, all of Fed. Rep. of Germany

[73] Assignee: Agfa Gevaert Aktiengesellschaft, Leverkusen, Fed. Rep. of Germany

[21] Appl. No.: 535,411

[22] Filed: Jun. 8, 1990

[30] Foreign Application Priority Data

Jun. 23, 1989 [DE] Fed. Rep. of Germany ..... 3920575

[51] Int. Cl.[5] ..... B05C 11/02; B05C 9/12

[52] U.S. Cl. ..... 118/56; 118/106; 118/109; 118/110

[58] Field of Search ..... 118/106, 109, 110, 56

[56] References Cited

U.S. PATENT DOCUMENTS

| | | | |
|---|---|---|---|
| 465,462 | 12/1891 | Claus | 118/110 |
| 2,642,030 | 6/1953 | Brink | 118/110 |
| 3,192,893 | 7/1965 | Bauer et al. | 118/106 |
| 3,908,588 | 9/1975 | Daunheimer et al. | 118/106 |
| 3,999,511 | 12/1976 | Schwandt et al. | 118/109 |
| 4,111,155 | 9/1978 | Klein et al. | 118/106 |
| 4,137,866 | 2/1979 | Heanley et al. | 118/106 |
| 4,765,270 | 8/1988 | Faber | 118/106 |

*Primary Examiner*—Willard E. Hoag

*Attorney, Agent, or Firm*—Connolly and Hutz

[57] ABSTRACT

An apparatus by which layer thickenings formed transversely to the direction of movement of a coated web are removed after the continuously moving web has been coated with liquids or dispersions, for example a web of photographic film or paper or magnetic recording carrier, are described. A deflecting roller (4) over which the web travels with its coated side facing the roller is situated downstream of the coating and drying devices. When a layer thickening approaches, a cleaning roller (2) covered with a fleece is swung into contact with the web, whereupon the web travels only over the cleaning roller.

3 Claims, 1 Drawing Sheet

APPARATUS FOR THE REMOVAL OF THICKENINGS FORMED IN COATINGS TRANSVERSELY TO THE DIRECTION OF MOVEMENT OF A COATED WEB

This invention relates to an apparatus and process by which thickenings formed in layers of coating transversely to the direction of movement of the coated web are removed after continuously moving webs have been coated with liquids or dispersions.

When webs are coated with liquids, for example with viscous, aqueous or organic solutions or with photographic gelatine/silver halide emulsions or with magnetic dispersions, thickenings in the layers due to an accumulation of coating material are formed when the coating device is placed into position (immersion) and when it is removed (re-emergence) or at points where lengths of web are glued together or the web itself is thickened. These thickenings extend transversely to the direction of movement of the web, in most cases across the whole width of the web. The immersion bulge is formed at the beginning of a coating operation due to an excess rate of supply of coating solution, which returns to normal more or less rapidly depending on the coating device, for example a cascade or extruder, until it reaches a state of equilibrium at which the coating mechanism applies a layer of constant thickness.

At the end of a coating operation, the re-emergence bulge is formed as the coating layer is separated from the support of the web. This bulge initially also extends as a thickening across the whole width of the web and then ends in "coating strands".

To join separate lengths of web together to form an endless web to be coated, the ends of the pieces are glued together by adhesive tape. This adhesive tape increases the thickness of the web and thus interferes with the mechanism for applying the layers of coating so that the layers increase and decrease in thickness until equilibrium is re-established. Thickenings may also form in the coatings due to coating faults produced by external influences or to localized thickenings in the web.

These thickenings may reach two to four times the normal thickness of the layers. Before a coated web can be rolled up, it must be completely dry at every point, including the thickened portions If these thickenings are not completely dry, they will cause the turns of the wound web to stick together so that the web subsequently cannot be unwound or will break when attempts are made to unwind it. Moreover, if a coating is not completely dry, it will soil any rollers with which it may come into contact, for example in the case of inline calendering of magnetic tapes, thereby impairing the quality of the tapes due to imprints, scratches and deformations.

A considerably greater drying capacity is required for drying the thickened portions of web than for drying the layers of normal thickness. This capacity can only be provided by increasing the length of the drying path, which entails high investment costs, or by reducing the speed of coating, which results in production loss and energy loss. Complete drying of the thickenings in the layer also has the disadvantage of impairing the quality of the normal layer since this is then overdried and becomes cracked and brittle and in the case of photographic material may cause fogging.

Even when the thickened portions of a layer have completely dried so that the web can be wound up into a roll, the pressure of the roll on the thickened portions causes imprints to form on the following and preceding turns of the roll, which frequently render large parts of the roll unusable if the layers are pressure sensitive.

Many different processes and apparatus have therefore been provided in pratice with the attempt to reduce or even completely prevent these layer thickenings.

DE-OS 26 33 316 discloses a process in which the coated web is first dried by the conventional method to dry the normal part of the layer and the coated web is then exposed to microwave drying which preferentially dries the thickened portions of the web while protecting the normal layer, which has a lower residual moisture content Although this procedure enables part of the energy to be saved in that only the thickened portions of the layer are after-dried, it does not eliminate the thickenings and these therefore still cause imprints or breakages due to pressure in the rolled up web. Moreover, the procedure only slightly shortens the drying path or only slightly increases the speed of drying since microwave drying also takes up a substantial amount of space.

According to DE-OS 19 04 928, the thickenings in the layer caused by joints in the web, especially adhesive joints, are to be eliminated by moistening these parts of the layer with a view to distributing the thickening. This measure, however, has little success since it does not significantly flatten out the thickenings. It has also been attempted to control the casting device so as to avoid a thickening in the layer when a thickened portion of web passes through the device. This is to be achieved by increasing the vacuum underneath the casting device shortly before the thickened portion of web passes through it and then eliminating the excess vacuum shortly after the passage of this part of the web (DE-AS 24 53 884). This procedure only provides a slight improvement and can only be employed with special coating devices.

DE-OS 30 19 459 describes an apparatus in which a pair of pivotally mounted air knives directed towards the web are arranged one on each side of a deflecting roller to scrape off the thickening on the layer and blow it into a vacuum tank in which the particles are washed off with water. This arrangement is relatively complicated in construction and would appear to give rise to problems at high speeds of travel of the web.

Lastly, DE-OS 28 03 914 describes an arrangement for smoothing the surface of magnetic recording carriers, in which a grinding device flattens the magnetic tape and a device having a cleaning fleece wrapped over it then cleans the tape. This arrangement is not suitable for removing relatively large thickenings.

It is therefore an object of the present invention to provide an apparatus and a process by which layer thickenings extending transversely to the direction of movement of the coated web can be completely removed even at high speeds of travel of the web without damage to the web or to the normal coating on the web.

The invention solves this problem by means of an apparatus and a process for the removal of layer thickenings extending transversely to the direction of movement of a web after the continuously moving web has been coated with liquids or dispersions, characterised in that a deflecting roller for deflecting the web and an immediately adjacent cleaning roller designed to be swung into position are provided behind the coating device for the web, the coated side of the web being passed over the rollers with the whole width of the coating in contact with the deflecting roller and the cleaning roller being swung into contact with the web when a layer thickness passes through the apparatus so that the web moves only over the cleaning roller, and the cleaning roller being swung away after the layer thickening has passed through, so that the web then travels only over the deflection roller. Further details of the invention will appear in the description and the drawings.

BRIEF DESCRIPTION OF THE DRAWINGS

The invention is described in more detail below with reference to the drawings, in which

FIG. 1 illustrates by way of example an embodiment of the apparatus. A web (1) covered with a layer (3) travels in the direction of the arrow from a casting machine followed by a drying apparatus into the cleaning apparatus (12) by way of a first deflecting roller (13), the web (1) being so arranged that its uncoated, rear surface is in contact with the deflecting roller (13). The cleaning apparatus (12) comprises a deflecting roller (4) over which the web (1) travels with its coated side (3) in contact with said roller. In the resting position, when the web is undisturbed by any adhesive joints, starting or stopping thickenings due to immersion or re-emergence or other layer thickenings, the layer travels over the roller (4) without soiling the roller. After having travelled through the apparatus, the web leaves in position A.

Before the arrival of a thickening in the layer of the moving web, the approach of which will be signalled as described below, the cleaning roller (2), which is in the resting position 2' and which is equal in width to the web, is pivoted into contact with the moving web so that the web is lifted from the deflecting roller (4) and the web now travels with its coated side only over the cleaning roller (2),which is preferably rotatable. The thickening in the material (not dry) can therefore make complete contact with the cleaning roller, which is preferably covered with an absorbent fleece. The contact pressure (surface pressure) which the cleaning roller exerts over the whole width of the web (1) is adjustable according to the composition of the layer and may reach values of up to 6 $Kp/cm^2$. The web then eaves the apparatus in the operative position, which is position B. After the layer thickening has passed through the apparatus, the cleaning roller is swung back into position 2' so that the web again travels with its coated side over the deflecting roller (4).

The cleaning roller which gets soiled with liquids or dispersions, may function repeatedly as described above and is only cleaned or covered with a new fleece when the coating installation is brought to a standstill.

In one variation, the fleece may also be cleaned in the resting position (position 2') by a device (not shown).

Figure 1:
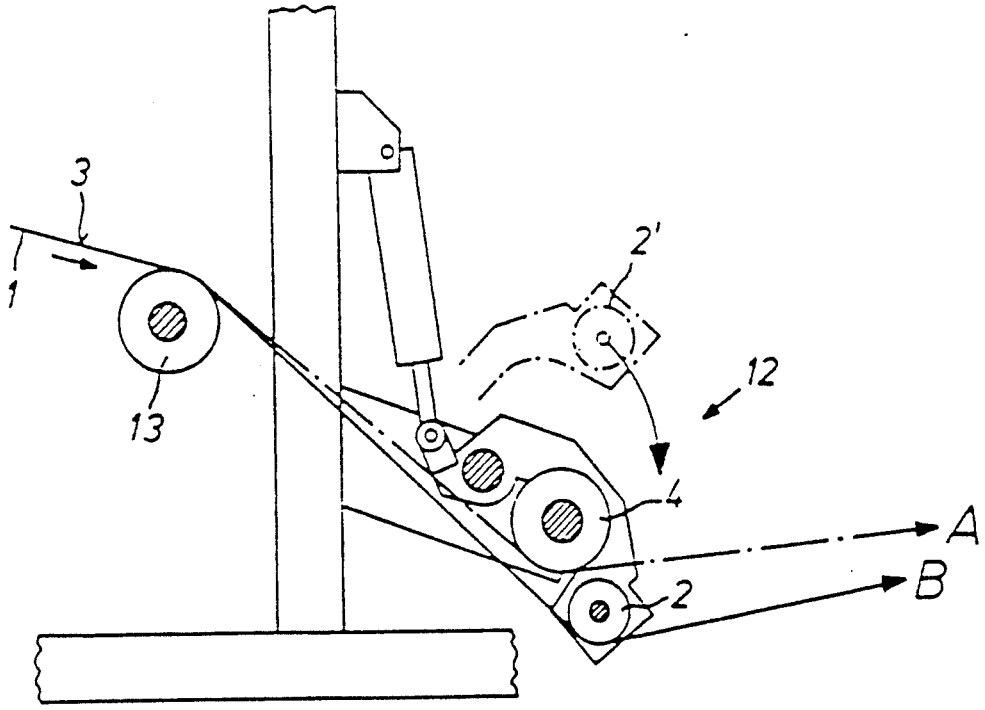
FIG. 1 is a side view of an apparatus according to the invention in the resting position and the operative position and FIG. 2 is a side view of another apparatus according to the invention in the operative position.
Figure 2:
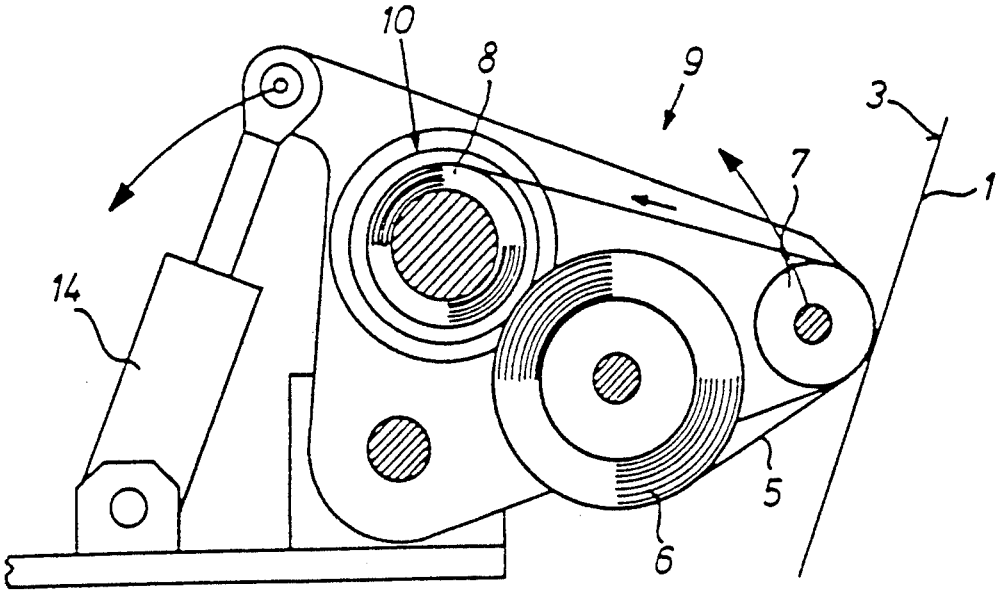

FIG. 2 shows another apparatus according to the invention. The web (1) in this case travels past the cleaning apparatus (9) with its coated side (3) facing the apparatus while the latter is swung away into the resting position (not shown) The apparatus (9) comprises a take-off roller (6) from which a web of cleaning fleece (5) equal in width to the web (1) can be wound off. The fleece travels over a deflecting roller (7) to be wound onto a driven roller (8). When a layer thickening approaches, the cleaning apparatus (9) is swung into complete contact with the web by means of one or two cylinders (14) so that the fleece (5) wrapped round the deflecting roller (7) scrapes off the thickening in the layer. when the layer thickening has moved past, the cleaning apparatus is swung back again and a specified length of fleece is moved forwards by means of the pneumatic rocking motor (10) and wound on while a clean fleece is pulled off the take-off roller (6).

It is surprisingly found that when several layers are applied in succession from a casting machine, the apparatus described above need only be put into operation after t he last layer has dried since the thickening in each layer is remoistened by the following layer and thus preserves its pasty state so that all the layer thickenings can be removed simultaneously after application of the last layer.

Switching on and off of the apparatus according to the invention may be carried out at the coating station, in which case the starting and stopping of the coating device, i.e. immersion and re-emergence, may be used for controlling the apparatus. The time of re-emergence from the apparatus is recorded and the apparatus is switched on according to a program following the movement of the web when the reemergence point has reached a position just before the apparatus. When coating is started, i.e. at immersion, the time is again recorded and to this is added a stabilizing time for the coating device and the apparatus is switched off according to the web monitoring program when the end of the thickening has passed through the apparatus.

Thickenings in layers may also be detected by measurements and used for switching the apparatus on and off. For this purpose, either the thickness of the layer or the moisture of the layer is measured upstream of the apparatus. If these values exceed a nominal value, the apparatus is switched on with a delay corresponding to the distance between the measuring point and the apparatus (program monitoring the movement of the web) and the apparatus is switched off again with delay when the measurement returns to the nominal value.

The apparatus and the process are distinguished by simplicity and reliability of function Damage to the web and its layers is avoided. It is surprisingly found that the apparatus is capable of completely removing all the layer thickenings due to immersion in and re-emergence from the coating device and adhesive joints or other thickenings in the web.

Application of the apparatus or of the process enables the drying time for coated webs to be reduced by 20 to 40% so that a considerable saving in energy, based on the length of web, can be achieved. When the apparatus and process are used in conjunction with an existing coating installation, this enables a larger quantity of material to be produced at a higher speed or the material to be dried more slowly so that its quality is improved.

We claim:

1. Apparatus for removing excess coating from a coated web, comprising:

a deflecting roller for deflecting the web and a cleaning roller immediately adjacent to the deflecting roller, both of rollers being mounted such as to be swingable into a position following means for applying coating to the web, the cleaning roller being movable into engagement with the web to remove excess coating material therefrom, the cleaning roller being removable from the web after the web portion having excess coating has passed the apparatus.

2. Apparatus according to claim 1 wherein the peripheral surface of the cleaning roller has a covering of absorbent fleece.

3. Apparatus for removing excess coating from a coated web comprising:

a cleaning apparatus having a fleece supply roller carrying a fleece web, a fleece take-up roller for winding the fleece web received from the supply roller and a deflection roller between the supply roller and the take-up roller, the cleaning apparatus being mounted so as to be swingable into a position following a coating means such that the fleece contacts excess coating on a web after the web has left the coating means whereby the excess coating is removed from the coated web, the fleece web being removable from contact with the coated web after the excess coating has been removed from the coated web.

* * * * *